United States Patent [19]

McCabe

[11] Patent Number: 4,661,336

[45] Date of Patent: Apr. 28, 1987

[54] PRETREATMENT OF PAN FIBER

[75] Inventor: Michael V. McCabe, Franklin, Ohio

[73] Assignee: Hitco, Irvine, Calif.

[21] Appl. No.: 801,417

[22] Filed: Nov. 25, 1985

[51] Int. Cl.[4] ..... D01F 9/12; D01C 5/00

[52] U.S. Cl. ..... 423/447.2; 423/447.4; 264/29.2

[58] Field of Search ..... 423/447.1, 447.2, 447.4; 8/115.65, 115.66; 528/492; 525/329.1, 329.2, 379, 382; 264/29.2; 118/429, 641

[56] References Cited

U.S. PATENT DOCUMENTS 4,031,188 6/1977 Kohler ..... 8/115.65

*Primary Examiner*—Michael R. Lusignan

*Attorney, Agent, or Firm*—Marvin E. Jacobs

[57] ABSTRACT

The rate of preoxidation-stabilization of polyacrylonitrile carbon fiber precursors is substantially increased by applying an aqueous solution of an accelerator compound containing a C=N group such as guanidine carbonate to the fiber, suitably by immersing the fiber in a bath of the solution.

14 Claims, 4 Drawing Figures

PRETREATMENT OF PAN FIBER

1. Technical Field

The present invention relates to manufacture of carbon-graphite high performance fibers from acrylic precursors and, more particularly, this invention relates to accelerating the rate of stabilization of polyacrylonitrite (PAN) fiber.

2. Background Art

High performance carbon-graphite fibers can be prepared from organic precursors such as acrylic polymers, polyvinyl alcohol, regenerated cellulose, pitch materials including petroleum residues, asphalt and coal tars. Highly oriented, synthetic polymer precursors such as acrylic polymers and regenerated cellulose provide better end characteristics. Acrylic precursors do not melt prior to pyrolytic decomposition and strength properties of graphitic fibers produced from acrylic precursors are substantially improved over regenerated cellulose based fibers. In addition to strength properties, other physical properties are improved.

The electrical conductivity is approximately five times that for regenerated cellulose based fibers and the degree of graphitization is substantially increased. This results from the fact that acrylic precursors yield a graphitic type of carbon as compared to the non-graphitic type of carbon produced from cellulosic materials. Furthermore, the carbon yield is approximately 45% as compared to only 25% from rayon. The volatiles given off from acrylic precursors do not cause fiber sticking, such as occurs from rayon based materials, so that yarn flexibility and strength are better. Yarn uniformity is more even and processing problems are fewer.

The procedure for converting an organic precursor into a high strength, high modulus fiber is rather complex. While much progress has been made in determining structure-property relationships of carbon-graphite materials, there is much remaining to be done in order to understand the effect of production parameters on fiber structure and properties.

Although carbon-graphite fibers are polycrystalline, they exhibit a high degree of preferred orientation which polycrystalline materials do not generally possess. The preferential arrangement of hexagonal graphite crystallites parallel to the fiber axis is responsible for the high strength exhibited by some of the currently available fibers. This high degree of orientation of the crystallites is probably due to the fact that the molecular chains in the precursor are oriented parallel to the fiber axis during stretching and therefore the graphitic nuclei will be more oriented.

Application of stress during some stage of the processing is required to develop high tensile strength levels. Both temperature and stress levels are important. It also has been found that oxidation of carbon-graphite precursor, especially of the acrylic type, prior to carbonization or graphitization is necessary to increase both the strength properties and weight yield of the final product. Stretching or restricting the filaments from shrinking has also been found to be beneficial during preoxidation.

The term preoxidation is not actually descriptive of this process step since two distinct chemical changes occur in the polymer during this step. Under application of heat, the polymer cyclizes, that is, forms a six member hexagon ring similar to that found in graphite. Heating in an oxygen containing atmosphere allows oxygen to diffuse into the structure of the fiber and forms cross-links or chemical bonds between the polymer chains. It has been fairly well established that the final product characteristics of a graphite yarn or fabric are determined primarily by what happens during the preoxidation-stabilization step.

Preoxidation of acrylic fiber is usually conducted at an elevated temperature of from about 400° F. to 600° F. for a period of from one to two hours, usually 60 to 90 minutes. Time, temperature, tension and atmosphere are all interrelated parameters and have to be controlled over this long processing period in order to control and optimize amounts of cyclization, oxygen content and orientation. Preoxidation as presently practiced adds a significant cost to the production of carbon or graphite fiber.

The preoxidation-stabilization step requires a substantially longer time to accomplish as compared with the rest of the process. For example, stabilization of PAN fiber can require 90 to 120 minutes whereas the subsequent carbonization requires less than ten minutes. Reducing the stabilization time will result in a faster process and increased efficiency and productivity.

STATEMENT OF THE INVENTION

Productivity of carbon fiber is greatly increased in the method of the invention. A fiber is produced having similar or better characteristics at substantially reduced cost by decreasing the time necessary for stabilization by a factor of at least one-half.

The method of the invention is able to achieve this dramatic reduction in stabilization time by applying an accelerator material to the surface of the fiber before preoxidation; suitably by dipping the fiber in an aqueous solution of the accelerator. The accelerator showing the fastest acceleration effect is a salt of guanidine, preferably guanidine carbonate, in a solution containing at least 0.1% by weight of guanidine. Experiments with other Lewis Acids or Lewis Base materials do not demonstrate any significant accelerating effect. Japanese Patent No.54-64546 discloses a flame retardant styrene-arylonitrile resin containing a guanidine derivative. British Patent GB 1504796 discloses an acrylonitrile copolymer spinning solution containing a guanidine modified dye. Japanese Patent No. 84-30824 discloses adding guanidine to an acrylic non-woven fabric to absorb formaldehyde odors. Such disclosures do not suggest nor indicate that a surface application of guanidine would accelerate the preoxidation of polyacrylonitrile fibers as partially cyclized precursors of carbon or graphite high modulus fibers.

These and many other features and attendant advantages of the invention will become apparent as the invention becomes better understood by reference to the following detailed description when considered in conjunction with the drawings.

DETAILED DESCRIPTION OF THE INVENTION

Figure 1:
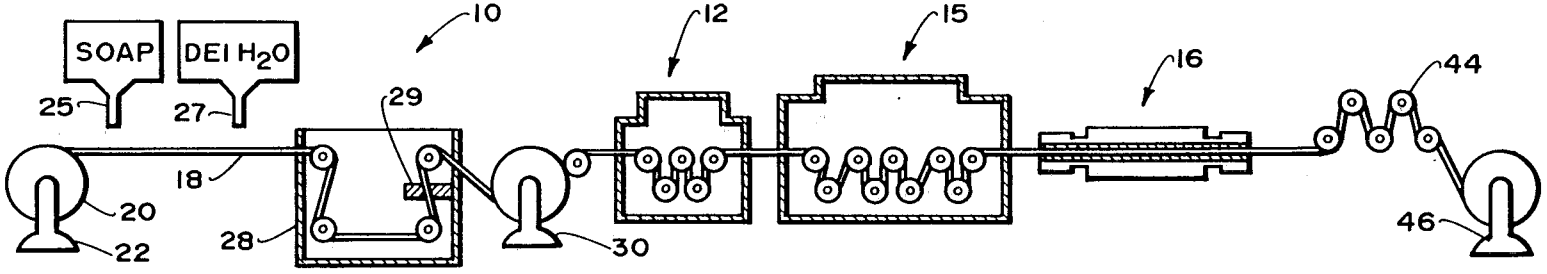
FIG. 1 is a schematic view of the process for treating acrylic fibers in accordance with the invention.

Referring now to FIG. 1, PAN fiber is converted to carbon-graphite fiber in the system of the invention generally comprising a train of apparatus including a washing section 10, impregnation station 12, preoxidation unit 15 and a carbonization section 16. The fiber 18 is unwound from the roll 20 on the unwind stand 22 and passes through the washing section 10. In the washing section a first set of nozzles 25 applies a solution of detergent to remove a silicone finish from the fibers. If the finish is not removed the accelerator will not uniformly impregnate the fiber, especially a multifilament fiber and the fiber will have non-uniform coloring and non-uniform properties. The detergent is removed as it passes by the rinse nozzles 27.

The accelerator can be applied by spraying, misting, brushing, padding or other processes. However, in order to assure uniformity of treatment, it is preferred to immerse the fiber in a tank 28 containing a solution of the accelerator. Sufficient accelerator is absorbed by the fiber in as little as a few seconds, typically about 30 seconds. Excess solution can be wiped from the fiber by passing it over a wiping pad 29 before it enters the stabilization-preoxidation unit 15.

The fiber 18 impregnated with a solution of accelerator is then passed through the remaining train of equipment. The fiber may be initially tensioned at unwind or braking stand 30 to apply an initial warp tension of about 5 ppi to the fiber 18.

The fiber is then subjected to stabilization in the preoxidation unit 15. The temperature in this unit is maintained between about 400° F. and about 525° F. The temperature may be constant throughout the unit or the temperature may be continuously or imcrementally increased in the unit. The fiber usually absorbs from 5 to 25% oxygen by weight in this unit, usually 12 to 15% oxygen by weight. The usual residence times of 0.5 to 6 hours is substantially decreased by the pretreatment with accelerator to residence times as low as 10 minutes. The oxygen content may be constant throughout the unit or may be maintained at different levels within zones.

The preoxidized, stabilized fiber can be cooled to a low temperature below about 100° F., suitably to room temperature and may be retensioned to about 80 ppi before being subjected to firing and graphitization in unit 16. Preferably the fiber is directly fed to the carbonization unit and fired at a temperature of about 1500° C. up to about 3000° C., suitably at about 2750° C., for about 0.1 to 10 minutes in an inert atmosphere. A tensioning unit 44 at the end of the unit 16 may be utilized to apply tension up to 80 ppi to the fiber during graphitization. When firing is completed, the fiber is cooled and rewound on a driven rewind stand 46.

The acrylic precursors may be homopolymers of acrylonitrile of copolymers produced by copolymizing not less than 85% of acrylonitrile with not more than 15 percent of a monovinyl compound such as methacrylate, methylmethacrylate, vinyl-acetate, vinyl-chloride, vinylidine chloride, 2-methyl-5-pyridine or the like. The precursor may be treated as filament, staple or batting or may be woven into continuous lengths of fabric.

The accelerator is a salt of an organic cation containing a C=N nitrilo group such as compounds of the formula:

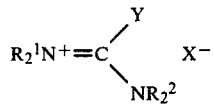

where $R^1$ and $R^2$ are individually selected from H, alkyl of 1 to 4 carbon atoms or alkoxy of 1–4 carbon atoms, Y is $—NR_2^3$ or $—CR_3^3$ where $R^3$ is defined as $R_1$ and X is an inorganic or organic anion such as carbonate, sulfate, nitrate or acetate. Representative accelerators are acetamidine ions of the formula:

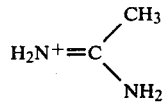

or guanidine ions of the formula:

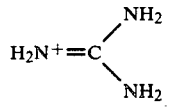

The accelerator is preferably applied to the fiber as an aqueous solution. The concentration of the accelerator in solution depends on speed of travel, the amount of fiber and the temperature in the preoxidation and carbonization units. Higher concentrations can be used in a static, stationary impregnation than in a continuous process. Generally, the concentration of accelerator is from 0.25 to 25% by weight, typically from 0.5 to 10 percent by weight in a continuous process. The solution may be at ambient or can be heated to a temperature from 20° C. to 80° C., usually around 40° C. to 60° C.

Experiments were conducted to elucidate the mechanism responsible for stabilization, Inorganic carbonates such as ammonium carbonate and sodium carbonate were shown to have no significant effect on stabilization while a variety of guanidine salts showed substantial effects on degree of conversion the best being guanidine carbonate. An acetamidine salt also showed an acceleration effect but less than guanidine salts.

Both the acetamidinium and guanidinium cations are singly charged and contain a carbon-nitrogen double band. The increased acceleration activity of the guanidinium ion may be due to its more perfect $D_{3h}$ symmetry and, thus, can achieve an enormous resonance stablization when protonated on the imine nitrogens. Due to this resonance stability, guanidine is one of the strongest organic bases known, with a $pK_a = 13.6$. Although acetamidinium does not possess the same type of symmetry as guanidinium, it still experiences some resonance stabilization which may account for its accelerating effects on the PAN stabilization reaction.

All experiments involved a control polyacrylonitrile fiber which had not received accelerator treatment but was the same in every other respect to the polyacrylonitrile fiber receiving treatment. The fibers were treated with aqueous solutions of the accelerator by dipping for thirty seconds. After thirty seconds of immersion in the aqueous solution, the fiber was wiped to remove excess solution and then wrapped on a fixture prior to thermal exposure. All laboratory work was performed at 240±1° C. in an oven with an air flow of 600–800 feet/min. The fibers were exposed to this environment for various time periods. After exposure the fibers were tested for residual exotherm and compared to the control fiber.

EXAMPLE 1

Unwashed Sumitomo PAN fiber (12,000 filament tow) was dipped in 4% aqueous guanidine carbonate solution at 50° C. for 30 seconds. The treated fiber and an untreated control were preoxidized at 240° C. in the air flow oven described above. The Degree of Conversion ($D_c$) was calculated as follows:

$$(D_c) = \frac{\Delta H_o - \Delta H}{\Delta H_o} \times 100;\ \Delta H_o\,(\text{air}) = 508.782\ \text{cal./g.}$$

The effect of the treatment on Sumitomo polyacrylonitrile fiber is shown in Table 1 and FIG. 1.

TABLE I

The Effect of Guanidine Carbonate on the Stabilization of Sumitomo PAN Fiber

| Treatment and Stabilization Time | Degree of Conversion (%) | |
|---|---|---|
| Guanidine Carbonate | Treated | Control |
| 15 minutes | 66.1 | 34.6 |
| 30 minutes | 70.4 | 47.0 |
| 60 minutes | 74.8 | 54.6 |

The data shows that the degree of comparison is substantially improved. In only 15 minutes of preoxidation the guanidine carbonate (GC) treated fibers are about two-thirds converted compared to only one-third conversion for the untreated control.

EXAMPLE 2

Figure 2:
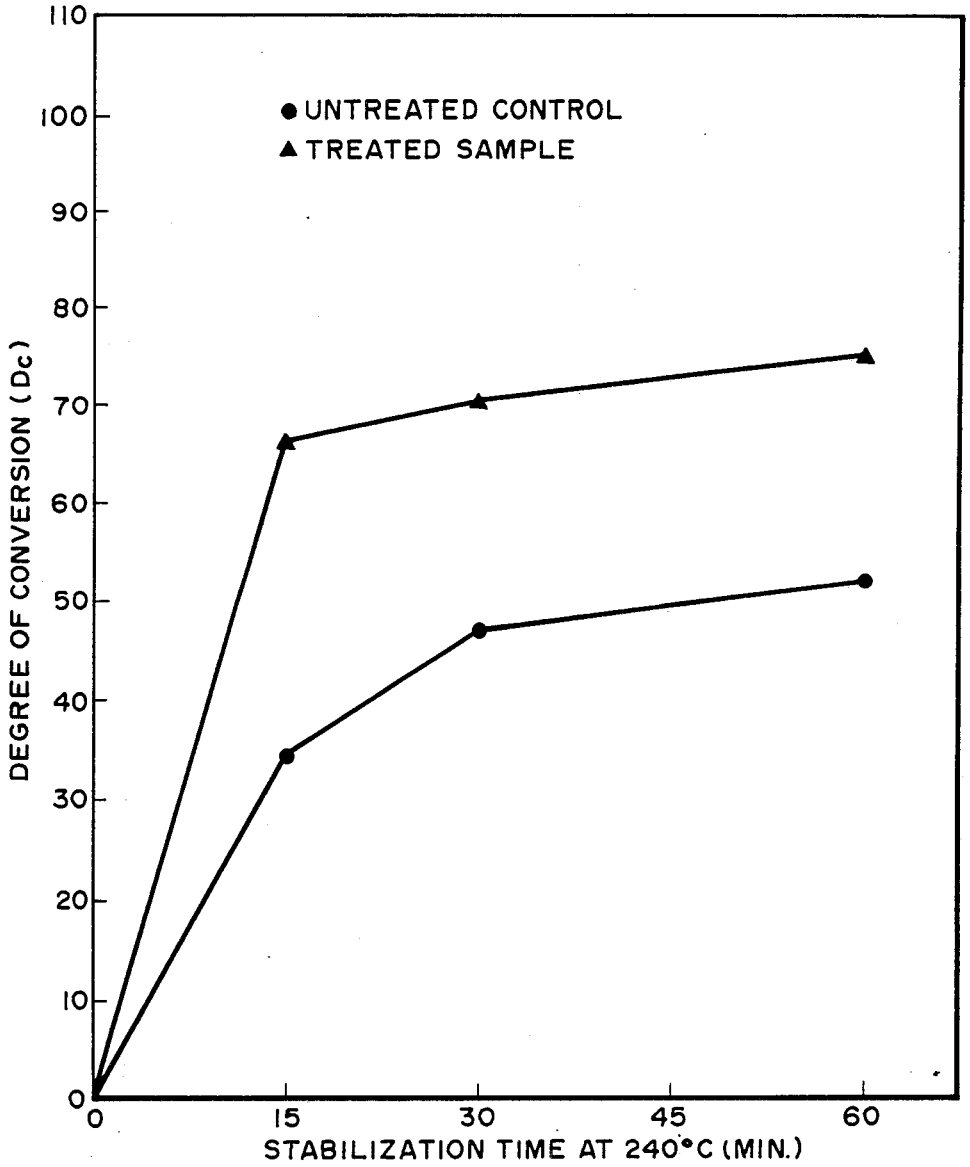
FIG. 2 is a set of curves of stabilization time of a set treated and untreated Sumitomo polyacrylonitrile fibers.

Example 1 was repeated utilizing a Dupont PAN fiber (26.7 mg/mm.) The effect of the treatment is shown in FIG. 2 and Table 2.

TABLE 2

The Effect of Guanidine Carbonate on the Stabilization of Dupont PAN Fiber

| | Degree of Conversion (%) | |
|---|---|---|
| Stabilization Time | Untreated Control | Guanidine Carbonate Treatment |
| 15 | 7.8 ± 2.7 | 39.2 |
| 30 | 11.4 ± 4.4 | 54.2 |
| 60 | 24.1 ± 5.2 | 57.8 |
| 90 | 33.0 ± 0.5 | |

As can be seen, the treatment greatly accelerates the degree of conversion to stabilized PAN fiber as compared to the untreated control. The effect of higher temperatures on the stabilization process was studied by raising the stabilization temperature to 255° C. The effect of concentration of the aqueous guanidine carbonate solution was also investigated. The results of these experiments with Dupont PAN fiber are shown in Table 3 and FIG. 3.

TABLE 3

The Effect of Temperature and Concentration on the Stabilization of Guanidine Carbonate Treated Dupont PAN Fiber.

| | Degree of Conversion at Various Stabilization Times (%) | | |
|---|---|---|---|
| Treatment | 15 min. | 30 min. | 60 min. |
| 4% Guanidine Carbonate Stabilization Temp-240° C. | 44.2 ± 7.0 | 55.8 ± 2.3 | 60.9 ± 4.4 |
| 15% Guanidine Carbonate Stabilization Temp-240° C. | 82.1 | -80.4 | 89.0 |
| 4% Guanidine Carbonate | 58.4 | 75.4 | 82.6 |

TABLE 3-continued

The Effect of Temperature and Concentration on the Stabilization of Guanidine Carbonate Treated Dupont PAN Fiber.

| | Degree of Conversion at Various Stabilization Times (%) | | |
|---|---|---|---|
| Treatment | 15 min. | 30 min. | 60 min. |
| Stabilization Temp-255° C. 15% Guanidine Carbonate | 89.4 | 88.8 | 88.5 |
| Stabilization Temp-255° C. Control at 240° C. | 8.0 ± 2.2 | 10.7 ± 3.8 | 24.4 ± 2.8 |
| Control at 255° C. | 19.3 ± 2.8 | 26.7 ± 3.3 | 61.2 ± 8.7 |

Raising the stabilization temperature to 255° C. exhibits about 2.5 times more conversion than the control fiber at 240° C. The fibers with the guanidine carbonate pretreatment which were stabilized at 255° C. also indicate a higher degree of conversion than the similarly treated fibers stabilized at 240° C.

Figure 3:
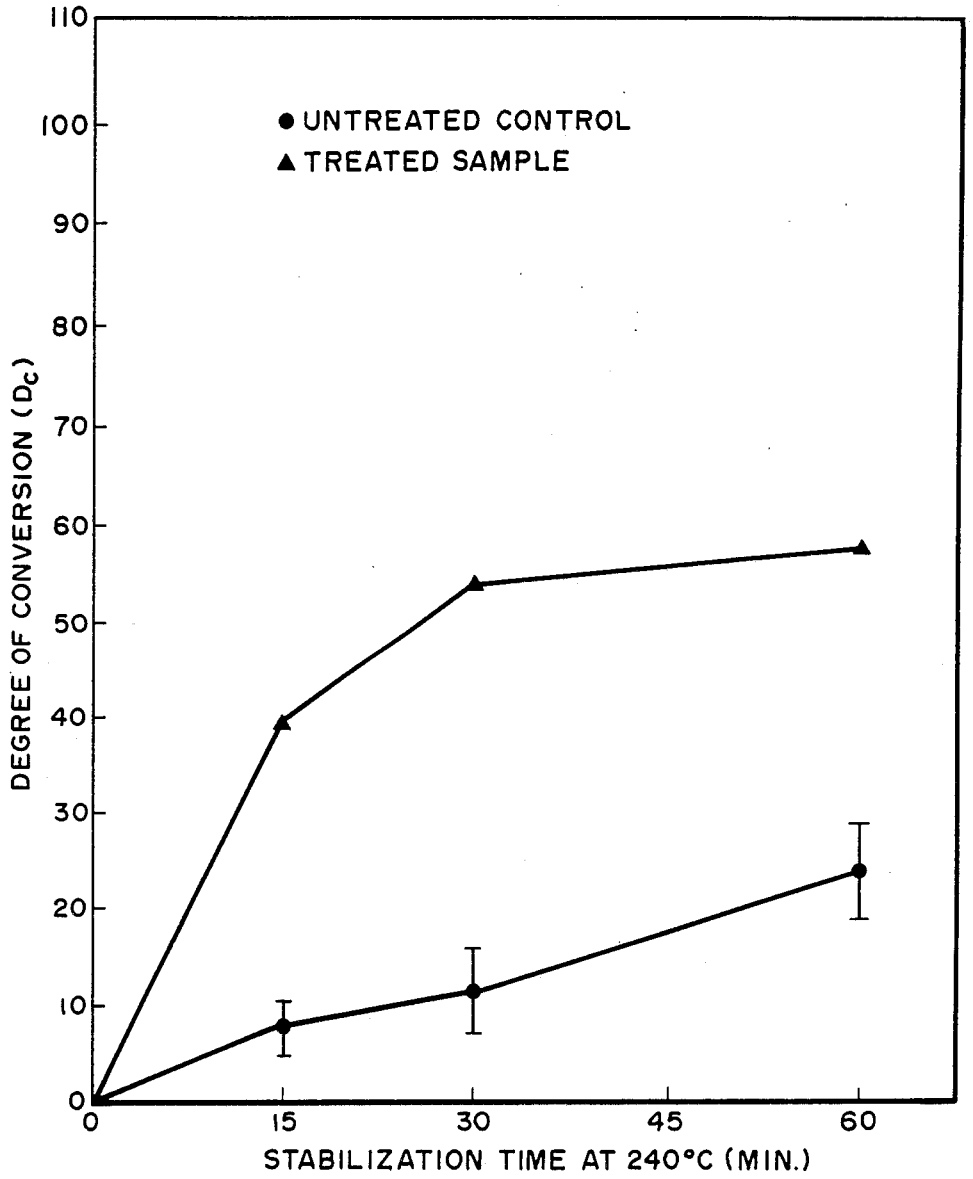
FIG. 3 is a set of curves of stabilization time of a set of treated and untreated Dupont polyacrylonitrile fibers.

Increasing the solution concentration of guanidine carbonate from 4% to 15% has a very substantial effect on the degree of stabilization of the Dupont PAN fiber as shown in Table 3 and FIG. 3. When the fiber is stabilized at 240° C., after fifteen minutes, the control is 8.0% stabilized, the fiber treated with 4% guanidine carbonate solution is 44.2% stabilized and the fiber treated with 15% guanidine carbonate solution is 8.21% stabilized. These increases are remarkable in that the fiber treated with the 15% solution of guanidine carbonate shows greater than a 900% increase in degree of conversion after fifteen minutes stabilization at 240° C. as compared to the untreated control. At a stabilization temperature of 255° C. after fifteen minutes stabilization time, the degree of conversion for the untreated control, the fiber treated with 4% guanidine carbonate, and the fiber treated with 15% guanidine carbonate are 19.3%, 58.4% and 89.4%, respectively. These data, and comparisons shown in FIG. 3, make it evident that employing a 15% solution of guanidine carbonate to pretreat Dupont PAN fiber will result in the amount of stabilization needed for carbonization after only fifteen minutes at either 240° C. or 255° C.

EXAMPLE 3

Example 1 was repeated except for the use of an aqueous detergent solution to wash the fibers before impregnation with the solution of guanidine carbonate to remove the silicone-based finish. The stabilized fabric exhibited very uniform color development throughout the fiber bundle. After 15 minutes at 240° C. the fiber is about 66% stabilized. Further treatment for 45 minutes resulted in 8.7% additional conversion.

EXAMPLE 4

Figure 4:
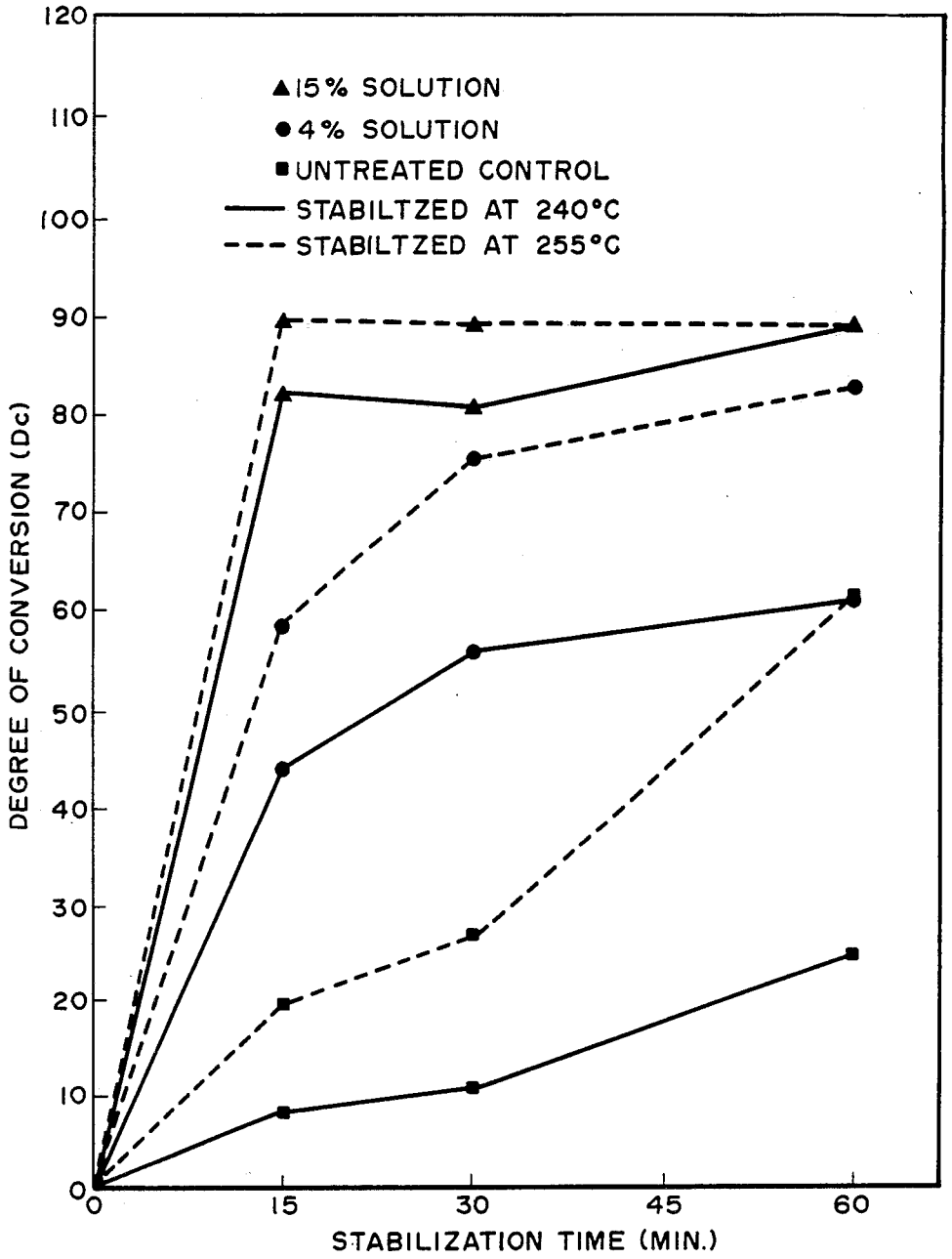
FIG. 4 is a series of curves showing stabilization times at different concentrations and different times.

Samples of the Dupont PAN fiber were treated with 4% aqueous solutions of acetamidine acetate and the nitrate, sulfate, and carbonate of guanidine and were stabilized according to the procedure of Example 1. The effect of these treatments is shown in Table 4 and FIG. 4.

TABLE 4

The Effect of Various Guanidine Salts and Acetamidine Acetate on the Stabilization of Dupont PAN Fiber at 240° C.

| | Degree of Conversion at Various Stabilization Times (%) | | |
|---|---|---|---|
| Treatment | 15 min. | 30 min. | 60 min. |
| Control | 8.0 ± 2.2 | 10.7 ± 3.8 | 24.4 ± 2.8 |
| 4% Guanidine Carbonate | 44.2 ± 7.0 | 55.8 ± 2.3 | 60.9 ± 4.4 |

TABLE 4-continued

The Effect of Various Guanidine Salts and Acetamidine Acetate on the Stabilization of Dupont PAN Fiber at 240° C.

| Treatment | Degree of Conversion at Various Stabilization Times (%) | | |
|---|---|---|---|
| | 15 min. | 30 min. | 60 min. |
| 4% Guanidine Sulfate | 30.8 | 49.3 | 57.2 |
| 4% Guanidine Nitrate | 29.9 | 47.2 | 49.9 |
| 4% Acetamidine Acetate | 22.0 | 30.0 | 51.6 |

Though the degree of conversion is not as good as with guanidine carbonate, the nitrate and sulfate show similar and substantial increases in the degree of conversion as compared to control. The effect of acetamidine acetate is still less but is almost 300% of that of the control at 15 and 30 minutes.

The effect of other carbonates on the stabilization of Dupont PAN fiber at 240° C. is shown in Table 5.

TABLE 5

| Treatment | Degree of Conversion at Various Stabilization Times (%) | |
|---|---|---|
| | 15 min. | 60 min. |
| Control | 8.0 ± 2.2 | 24.4 ± 2.8 |
| 4% $(NH_4)_2CO_3$ | −0.5 | 28.8 |
| 4% $Na_2CO_3$ | −3.0 | 27.6 |

The two carbonate solutions tested have no significant effect on the degree of conversion of PAN fiber. This clearly indicates that the guanidine ion is responsible for the accelerator effect.

Since the above tests demonstrate the ability of guanidine carbonate treatment to reduce stabilization time to 15 minutes or less, pilot plant experiments were conducted to continuously prepare carbon fiber from the pretreated, stabilized fiber and to test the properties of the final carbon fiber.

The fiber was a Mitsubishi 12K PAN fiber. The pilot plant included a multi-stage oxidizer and a Centorr furnace carbonization unit. A set of strands of the fiber were dipped in deionized water (DI) at 50° C. and other sets of strands were dipped in 0.5, 2.0, 3.0 and 4% guanidine carbonate solutions. The residence time of the fiber in the solution was controlled by varying the level of the solution in the dipping apparatus using the line spread of the fiber as a guide. The fibers were oxidized with the stages heated as follows: 235° C./245° C./255° C. Residence time in each zone was 35 minutes and the tension was controlled to −11% stretch. The fibers were carbonized at 1100°-1200° C. and 6 or 12 ipm.

The control sample which was dipped in (DI) showed no change in the oxidized fiber density and no significant effect during oxidation or carbonization. The sample of fiber treated for 30 seconds in 0.5% guanidine carbonate also showed no significant change in oxidized fiber density and no significant change in the tensile properties. A rapid change in color in the first oxidation zone was observed. In the case of the fiber treated with 2% guanidine carbonate solution the fiber density increased from 1.30 to 1.33 as compared to DI treated control and when this fiber was carbonized at 1100° C. at 6 ipm, −3% shrinkage conditions the treated fiber tensile strength increased to 347 KSI as compared to 249 KSI for the DI control providing a significant 98 KSI increase.

A carbonization trial was done using the same fiber oxidized at 235° C./245° C./255° C. for 0.25H /aone with 11% stretch. Two ends of fiber were treated with 2% guanidine carbonate prior to oxidation and two with DI water. These four ends were carbonized at the same time in the Centorr furnace at 1100° C. at 6 ipm −3% shrinkage and at 1200° C. at 12 ipm −3% shrinkage.

The 1100° C. carbonized fibers gave an average tensile strength of 392 KSI and the untreated carbon fibers gave an average tensile strength of 282 KSI. The 2% guanidine carbonate treated fiber gave a higher tensile properties than that of the untreated fiber by 110 KSI to that of the untreated fiber. The same characteristic was also observed at 1200° C. carbonization. The 2% guanidine carbonate treated fiber gave a higher tensile properties than that of the untreated fiber by 118 KSI. The 2% guanidine treated fiber gave an average tensile properties of 337 KSI and the untreated fiber gave an average tensile properties of 219 KSI. The average modulus for the untreated and 2% guanidine treated fibers at 1200° C. carbonization were 30.7 MSI and 30.85, respectively. For 1100° C. carbonization the untreated carbon fiber and the 2% guanidine carbonate were 29 MSI and 29.8 MSI, respectively.

Another experiment was conducted with the concentration of the guanidine carbonate increased to 4%. The temperature of the 4% guanidine carbonate was controlled at 50° C. The fiber residence time in the solution was still at 30 seconds. The oxidation temperature was 235° C. in the first zone, 245° C. in the second zone and 255° C. in the third zone. The oxidation stretch condition was also at 11%. Four attempted trials were made in the multi-stage oxidizer and each and every time at 235° C. temperature in the first zone, the 4% guanidine carbonate treated fiber were frying badly causing it to wrap in the first top roller.

In the next experiment the concentration of the guanidine carbonate solution was reduced to 3%. All other operating conditions and parameters from the pervious experiment were not changed. It was also observed that the 3% guanidine carbonate treated fiber was still frying at 235° C. temperature in the first zone but not as badly as the 4% guanidine carbonate treated fiber. The oxidized fiber density of the untreated fiber from this experiment was 1.31 and the 3% guanidine carbonate treated fiber was 1.35. It appears that in this particular pilot plant the optimum concentration of guanidine carbonate appears to be about 2.0 to 2.5% by weight at 50° C.

Pretreatment of PAN fibers with a C=N accelerator, particularly guanidine carbonate, before preoxidation tremendously increases the rate of stabilization of the fiber. The accelerator is easily applied to the surface of the fiber as an aqueous solution. The pretreatment is effective on a variety of PAN fibers. The pretreatment also provides a fiber with an increased density and a substantially higher tensile strength. The pretreatment of the invention reduces the time needed for stabilization to the order of 10 to 20 minutes which is similar to the period needed for carbonization which greatly facilitates continuous operation.

It is to be realized that only preferred embodiments of the invention have been described and that numerous substitutions, modifications, and alterations are permissible without departing from the spirit and scope of the invention as defined in the following claims.

I claim:

1. a method of heating an acrylic fiber comprising the steps of:

applying to the fiber an effective amount of an accelerator including an aqueous solution of a salt having a cation containing —C=N group and then;

heating the fiber in an oxygen containing atmosphere to form a stabilized fiber.

2. A method according to claim 1 further including the step of carbonizing the stabilized fiber by heating it to a temperature above 1500° C. in an inert atmosphere.

3. A method according to claim 1 in which the acrylic fiber is a polymer containing at least 80% acrylonitrile and not more than 15% of a monovinyl monomer selected from methacrylate, methyl methacrylate, methacrylic acid, vinyl acetate, vinyl chloride, vinylidene chloride, 2-methyl-5-vinyl pyridine or itaconic acid.

4. A method according to claim 3 in which the accelerator is a salt of the formula

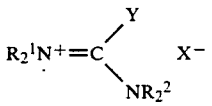

where $R^1$ and $R^2$ are individually selected from $H_1$ alkyl of 1 to 4 carbon atoms or alkoxy of 1 to 4 carbon atoms,

3 3 where R3 is selected from H, alkyl Y is $—NR_2^3$ or $CR_3^3$ where $R^3$ is selected from H, alkyl of 1 to 4 carbon atoms or alkoxy of 1 to 4 carbon atoms and X is an anion.

5. A method according to claim 4 in which X is selected from carbonate, sulfate, nitrate or acetate.

6. A method according to claim 5 in which $R_1$, $R^2$ and $R^3$ are H.

7. A method according to claim 6 in which Y is $NH_2$.

8. A method according to claim 7 in which the anion is carbonate.

9. A method according to claim 1 in which accelerator is applied to the fiber as an aqueous solution.

10. A method according to claim 1 in which the solution is applied to the fiber by immersing the fiber in the solution.

11. A method according to claim 10 in which the concentration of accelerator in the solution is from 0.25 to 25% by weight.

12. A method according to claim 1 in which the fiber is heated in air at a temperature of from 400° F. to 600° F.

13. A method according to claim 12 in which the fiber is heated in air for a period of less than 30 minutes.

14. A fiber treated in accordance with the method of claim 1.

* * * * *